US010267311B2

(12) United States Patent
Sato et al.

(10) Patent No.: US 10,267,311 B2
(45) Date of Patent: Apr. 23, 2019

(54) HORIZONTAL STEP SCROLL COMPRESSOR WITH BYPASS PORTS

(71) Applicant: MITSUBISHI HEAVY INDUSTRIES THERMAL SYSTEMS, LTD., Tokyo (JP)

(72) Inventors: Hajime Sato, Tokyo (JP); Toshiyuki Goto, Tokyo (JP); Takahide Ito, Tokyo (JP); Hisao Mizuno, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 212 days.

(21) Appl. No.: 15/316,909

(22) PCT Filed: May 20, 2015

(86) PCT No.: PCT/JP2015/064500
§ 371 (c)(1),
(2) Date: Dec. 7, 2016

(87) PCT Pub. No.: WO2016/027533
PCT Pub. Date: Feb. 25, 2016

(65) Prior Publication Data

US 2017/0122317 A1 May 4, 2017

(30) Foreign Application Priority Data

Aug. 22, 2014 (JP) ..... 2014-169579

(51) Int. Cl.
*F04C 18/02* (2006.01)
*F04C 28/10* (2006.01)
*F04C 28/26* (2006.01)

(52) U.S. Cl.
CPC ..... *F04C 18/0276* (2013.01); *F04C 18/0215* (2013.01); *F04C 28/10* (2013.01); *F04C 28/26* (2013.01)

(58) Field of Classification Search
CPC ..... F04C 18/0276; F04C 28/26
See application file for complete search history.

(56) References Cited

U.S. PATENT DOCUMENTS 4,774,816 A 10/1988 Uchikawa et al.
6,273,691 B1 8/2001 Morimoto et al.
(Continued)

FOREIGN PATENT DOCUMENTS

EP 2 280 172 A1 2/2011
JP 61-252887 A 11/1986
(Continued)

*Primary Examiner* — Mary Davis
(74) *Attorney, Agent, or Firm* — Birch, Stewart, Kolasch & Birch, LLP

(57) ABSTRACT

Provided is a horizontal step scroll compressor with which liquid compression can be effectively prevented even when starting up from a liquid migration state in which liquid refrigerant has migrated into the compressor while operation of the compressor is stopped. In this horizontal step scroll compressor, bypass ports, which divert pressure into a discharge chamber when the pressure in a pair of compression chambers reaches or exceeds a set pressure at an intermediate compression position between a suction cutoff position and the position communicating with a discharge port, are provided along the spiral direction of spiral wraps. Among these bypass ports, the opening area of the bypass ports that open into the first compression chamber, which includes the step parts in the gravity direction when a step part and a step part, and a step part and a step part, begin to engage each other, is greater than the opening area of the bypass port, which opens to the second compression chamber forming a pair with the first compression chamber.

9 Claims, 9 Drawing Sheets

(56) References Cited

U.S. PATENT DOCUMENTS

| | | | | |
|---|---|---|---|---|
| 7,344,365 | B2 * | 3/2008 | Takeuchi | F04C 18/0276 418/55.1 |
| 8,075,290 | B2 * | 12/2011 | Ginies | F04C 18/0276 418/55.2 |
| 2002/0054821 | A1 | 5/2002 | Takeuchi et al. | |

FOREIGN PATENT DOCUMENTS

| | | | |
|---|---|---|---|
| JP | 63-140884 | A | 6/1988 |
| JP | 10-037869 | A | 2/1998 |
| JP | 2000-345976 | A | 12/2000 |
| JP | 2002-303281 | A | 10/2002 |
| JP | 2004-270667 | A | 9/2004 |
| JP | 2009-287512 | A | 12/2009 |
| JP | 2015-055173 | A | 3/2015 |

* cited by examiner

HORIZONTAL STEP SCROLL COMPRESSOR WITH BYPASS PORTS

TECHNICAL FIELD

The present invention relates to a horizontal step scroll compressor in which step parts are provided in positions of a stationary scroll and a revolving scroll following a spiral direction.

BACKGROUND ART

A so-called step scroll compressor, in which step parts are provided in each of positions of tooth crests and tooth bases in spiral wraps of a stationary scroll and a revolving scroll along the spiral directions thereof, and a height of the spiral wrap on an outer peripheral side thereof is greater than a height of the wrap on an inner peripheral side thereof on the respective sides of the step parts, is capable of compressing a refrigerant gas not only in a circumferential direction of the spiral wraps but also in a wrap height direction (that is, is capable of three-dimensional compression). The step scroll compressor is thus capable of a greater amount of displacement and a higher compressor volume than a scroll compressor not provided with steps (two-dimensional compression). Accordingly, the compression ratio can be increased and the performance of the compressor can be improved without increasing the outer diameter of the compressor, and thus the compressor can be made smaller and more lightweight.

Among such step scroll compressors, Patent Document 1 discloses a step scroll compressor provided with an overcompression prevention mechanism that, when the pressure in a compression chamber rises abnormally and reaches or exceeds a set pressure before the pressure communicates with a discharge port, diverts the pressure to a discharge chamber via a bypass port and a bypass valve. On the other hand, Patent Document 2 discloses a two-dimensional compression-type scroll compressor, in which the stationary scroll and the revolving scroll have different numbers of turns, where bypass ports provided in a posterior compression chamber and an anterior compression chamber that form a pair are given different positions and sizes (numbers) in order to alleviate overcompression and liquid compression.

Additionally, Patent Document 3 discloses a horizontal scroll compressor in which a drive shaft is arranged in the horizontal direction, where at least four relief ports and one discharge port are provided between a compression chamber formed by the two scrolls and a discharge chamber, a relief valve is provided in each port, and one of the relief ports or the discharge port is configured to constantly communicate with the compression chamber. This makes it possible to prevent liquid compression and overcompression throughout the entire compression stroke.

CITATION LIST

Patent Literature

Patent Document 1: Japanese Unexamined Patent Application Publication No. 2009-287512A Patent Document 2: Japanese Unexamined Patent Application Publication No. 2004-270667A Patent Document 3: Japanese Unexamined Patent Application Publication No. 2000-345976A

SUMMARY OF INVENTION

Technical Problem

However, none of Patent Documents 1 to 3 disclose a technique for effectively preventing liquid compression when a horizontal step scroll compressor is started up from a state in which liquid refrigerant has migrated and accumulated within the compression chamber while the operation of the compressor is stopped. If a scroll compressor is started up in a state where liquid refrigerant has accumulated, the scroll wraps may be damaged by liquid compression. Techniques that provide a bypass port and divert the liquid refrigerant to a discharge chamber are thus employed to prevent excessive liquid compression.

In the case of a horizontal scroll compressor in which the drive shaft is arranged horizontally, refrigerant liquid typically migrates to the compression chamber on the lower side in the gravitational direction and accumulates therein. It is thus thought that liquid compression arises more easily in the compression chamber on the lower side of the gravitational direction. Under these circumstances, analysis carried out by the inventors revealed that in a horizontal step scroll compressor, the posterior compression chamber and anterior compression chamber that form a pair communicate when the step parts disengage from each other. Accordingly, it is not always the case that liquid compression arises more easily in the compression chamber on the lower side in the gravitational direction; rather, it was discovered that liquid compression will arise more easily in the compression chamber where the step parts are present on the lower side in the gravitational direction when the step parts begin to engage. The result of this analysis will be described hereinafter.

FIGS. 6A to 6D illustrate compression operations in the case where the compressor is started up from a state in which liquid refrigerant has accumulated to a height position of approximately 50% in the compression chamber. Here, step parts 13D and 13E, and 14D and 14E, are provided in predetermined positions along a spiral direction of tooth crests and tooth bases of spiral wraps 13B and 14B of a stationary scroll 13 and a revolving scroll 14, respectively. The drawings illustrate a case where the step part 13E in the tooth base and the step part 14D in the tooth crest on the lower side in the gravitational direction that engage with each other are set to a position of 45° on the lower-left when the scrolls 13 and 14 are engaged.

FIG. 6A illustrates a state where a scroll turn angle is at a suction cutoff position, and the step parts 13E and 14D and the step parts 13D and 14E are in engagement end positions. It is assumed in this case that the liquid refrigerant has accumulated within a lower-side compression chamber (stationary anterior compression chamber) 15A up to the level of a horizontal line passing through the centers of the scrolls. FIG. 6B illustrates a state arrived at after the turn angle has advanced by 90° from the state illustrated in FIG. 6A. Here, the step parts 13E and 14D and the step parts 13D and 14E disengage, and thus the stationary anterior compression chamber 15A and the stationary posterior compression chamber 15B that form a pair communicate, and the liquid refrigerant that had been accumulated in the stationary anterior compression chamber 15A in FIG. 6A moves toward the stationary posterior compression chamber 15B that forms the pair therewith.

FIG. 6C illustrates a state arrived at after the turn angle has advanced by 90° from the state illustrated in FIG. 6B. At this position, the step parts 13E and 14D and the step parts 13D and 14E begin to engage, and the liquid refrigerant is trapped within both compression chambers 15A and 15B. At this time, a greater amount of the liquid refrigerant is trapped in the stationary posterior compression chamber 15B including the step parts 13E and 14D on the lower side in the gravitational direction than is trapped in the stationary anterior compression chamber 15A. This liquid refrigerant is compressed in the subsequent process leading to the state illustrated in FIG. 6D, arrived at after the turn angle has advanced by another 90°, and liquid compression arises as a result.

Thus, in the case of a horizontal step scroll compressor, liquid compression does not necessarily arise easily in the compression chamber (stationary anterior compression chamber) 15A located on the lower side in the gravitational direction at the time of startup, as with a two-dimensional compression-type horizontal scroll compressor that lacks step parts. Liquid compression will arise more easily on the side of the compression chamber (stationary posterior compression chamber) 15B including the step parts 13E and 14D on the lower side in the gravitational direction when the step parts 13E and 14D and the step parts 13D and 14E begin to engage.

Although FIGS. 6A to 6D illustrate a case where the step parts 13E and 14D on the lower side in the gravitational direction are set to a position of 45° on the lower-left relative to the horizontal direction, it was discovered that by changing the positions of the step parts 13E and 14D, the amount of liquid refrigerant trapped in the stationary posterior compression chamber 15B including the step parts 13E and 14D on the lower side in the gravitational direction changes when the step parts 13E and 14D and the step parts 13D and 14E begin to engage. The circumstances of this change will be described using FIGS. 7A to 9D.

FIGS. 7A to 7D illustrate compression operations in the case where the positions of the step parts 13E and 14D on the lower side in the gravitational direction are set to a center-bottom position, FIGS. 8A to 8D illustrate compression operations in the case where the positions of the step parts 13E and 14D on the lower side in the gravitational direction are set to a position of 45° on the lower-right, and FIGS. 9A to 9D illustrate compression operations in the case where the positions of the step parts 13E and 14D on the lower side in the gravitational direction are set to a center-side position (a horizontal position). In these diagrams, it can be seen that the amount of liquid refrigerant trapped in the compression chamber (stationary posterior compression chamber) 15B including the step parts 13E and 14D on the lower side in the gravitational direction is different when the step parts 13E and 14D and the step parts 13D and 14E begin to engage, as is clear by comparing FIGS. 7C, 8C, and 9C.

In other words, in the case of FIG. 6C, when the step parts 13E and 14D and the step parts 13D and 14E begin to engage, there is a far greater amount of liquid refrigerant trapped on the side of the stationary posterior compression chamber 15B including the step parts 13E and 14D on the lower side in the gravitational direction than in the stationary anterior compression chamber 15A that forms a pair therewith, making it easy for liquid compression to arise. Meanwhile, in the case of FIG. 7C, there is a far greater amount of liquid refrigerant trapped on the side of the stationary posterior compression chamber 15B including the step parts 13E and 14D on the lower side in the gravitational direction than in the stationary anterior compression chamber 15A that forms a pair therewith, as in the case of FIG. 6C.

As opposed to this, in the case of FIG. 8C, it can be seen that the amount of liquid refrigerant trapped on the side of the stationary posterior compression chamber 15B including the step parts 13E and 14D on the lower side in the gravitational direction has dropped to slightly more than approximately half the amount of the refrigerant trapped in the stationary anterior compression chamber 15A that forms a pair therewith. Furthermore, in the case of FIG. 9C, it can be seen that the amount of liquid refrigerant trapped on the side of the stationary posterior compression chamber 15B including the step parts 13E and 14D on the lower side in the gravitational direction is slightly less but still approximately half the amount of the refrigerant trapped in the stationary anterior compression chamber 15A that forms a pair therewith.

Having been achieved in light of the above-described knowledge, an object of the present invention is to provide a horizontal step scroll compressor with which liquid compression can be effectively prevented even when starting up from a liquid migration state in which liquid refrigerant has migrated into the compressor while operation of the compressor is stopped.

Solution to Problem

A horizontal step scroll compressor of the present invention employs the following means to solve the problems described above.

That is, a horizontal step scroll compressor according to a first aspect of the present invention is a horizontal step scroll compressor in which step parts are provided in each of positions of tooth crests and tooth bases in spiral wraps of a stationary scroll and a revolving scroll forming a pair of compression chambers along the spiral directions thereof, and in which a height of the spiral wrap on an outer peripheral side thereof is greater than a height of the wrap on an inner peripheral side thereof on the respective sides of the step parts. Here, bypass ports that, when a pressure in the pair of compression chambers reaches or exceeds a set pressure at an intermediate compression position between a suction cutoff position and a position communicating with a discharge port, divert the pressure into the discharge chamber are provided along a spiral direction of spiral wraps. Among the bypass ports, an opening area of the bypass port that opens into a first compression chamber including the step parts on a lower side in a gravitational direction when the step parts begin to engage is greater than an opening area of the bypass port that opens into a second compression chamber forming a pair with the first compression chamber.

In the horizontal scroll compressor, refrigerant liquid migrates and accumulates in a compression chamber located on a lower side in the gravitational direction while the compressor is stopped, and it is thus easier for liquid compression to arise on the side of the compression chamber located on the lower side in the gravitational direction when the compressor is started. However, in the case of a so-called step scroll compressor, a posterior compression chamber and an anterior compression chamber that form a pair communicate when the step parts disengage. As such, it is not necessarily the case that liquid compression arises easily in the compression chamber on the lower side in the gravitational direction; rather, liquid compression arises more easily on the side of the compression chamber including the step parts on the lower side in the gravitational direction when the step parts begin to engage.

According to the present invention, bypass ports that, when a pressure in the pair of compression chambers reaches or exceeds a set pressure at an intermediate compression position between a suction cutoff position and a position communicating with a discharge port, divert the pressure into the discharge chamber are provided along a spiral direction of spiral wraps. Among the bypass ports, an opening area of the bypass port that opens into a first compression chamber including the step parts on the lower side in a gravitational direction when the step parts begin to engage is greater than an opening area of the bypass port that opens into a second compression chamber forming a pair with the first compression chamber. As such, even if the horizontal step scroll compressor has been started up in a state where liquid refrigerant has accumulated, excessive liquid compression can be prevented from arising on the first compression chamber side, where it is easy for liquid compression to arise, by diverting the liquid refrigerant trapped in the first compression chamber including the step parts on the lower side in the gravitational direction when the step parts begin to engage, to the discharge chamber via the bypass port whose opening area is greater. Thus liquid compression can be effectively prevented during liquid migration startup of the horizontal step scroll compressor, which makes it possible to reduce the risk of damage or the like to the scrolls caused by liquid compression and improve the reliability thereof.

Additionally, in the horizontal step scroll compressor according to the first aspect of the present invention, it is preferable that an opening area of a second bypass port open in a range from a position before the first compression chamber is closed to the bypass port to a position where the first compression chamber communicates with the discharge port also be greater than an opening area of a second bypass port open in a range from a position before the second compression chamber is closed to the second bypass port to a position where the second compression chamber communicates with the discharge port.

According to the present invention, an opening area of a second bypass port open in a range from a position before the first compression chamber is closed to the bypass port to a position where the first compression chamber communicates with the discharge port is also greater than an opening area of a second bypass port open in a range from a position before the second compression chamber is closed to the second bypass port to a position where the second compression chamber communicates with the discharge port. As such, when liquid compression arises in the first compression chamber in a range of engagement from a position where the first compression chamber is closed to the bypass port to when the first compression chamber communicates with the discharge port as well, that liquid refrigerant can be diverted to the discharge chamber via the second bypass port whose opening area is greater. Accordingly, liquid compression in the first compression chamber can be reliably prevented in the overall compression process following the beginning of engagement of the step parts, and the durability and reliability of the horizontal step scroll compressor can be ensured with respect to liquid migration startup.

Furthermore, in the horizontal step scroll compressor according to the first aspect of the present invention, it is preferable that the opening area be increased by providing a greater number of bypass ports and/or second bypass ports opening into the first compression chamber than bypass ports and/or second bypass ports opening into the second compression chamber.

According to the present invention, the opening area is increased by providing a greater number of bypass ports and/or second bypass ports opening into the first compression chamber than bypass ports and/or second bypass ports opening into the second compression chamber. As such, in a situation where the diameter of this type of port is limited to no greater than a predetermined diameter, the opening area can be increased easily by increasing the number of ports. Accordingly, during liquid migration startup, liquid refrigerant trapped in the first compression chamber can be diverted smoothly through the bypass ports and/or second bypass ports whose opening area has been increased by increasing the number of ports, and thus liquid compression can be reliably prevented on the first compression chamber side.

Furthermore, in the horizontal step scroll compressor according to the first aspect, it is preferable that the opening area be increased by giving the bypass ports and/or second bypass ports opening into the first compression chamber a greater port area per port than the port area per port of the bypass ports and/or second bypass ports opening into the second compression chamber.

According to the present invention, the opening area is increased by giving the bypass ports and/or second bypass ports opening into the first compression chamber a greater port area per port than the port area per port of the bypass ports and/or second bypass ports opening into the second compression chamber. As such, in a situation where the diameter of this type of port is limited to no greater than a predetermined diameter, the opening area can be increased easily by making each port a long hole, for example, to change the port area thereof. Accordingly, during liquid migration startup, liquid refrigerant trapped in the first compression chamber can be diverted smoothly through the bypass ports and/or second bypass ports whose opening area has been increased by increasing the port area per port, and thus liquid compression can be reliably prevented on the first compression chamber side.

Furthermore, a horizontal step scroll compressor according to a second aspect of the present invention is a horizontal step scroll compressor in which step parts are provided in each of positions of tooth crests and tooth bases in spiral wraps of a stationary scroll and a revolving scroll forming a pair of compression chambers along the spiral directions thereof, and in which a height of the spiral wrap on an outer peripheral side thereof is greater than a height of the wrap on an inner peripheral side thereof on the respective sides of the step parts. Here, bypass ports that, when a pressure in the pair of compression chambers reaches or exceeds a set pressure at an intermediate compression position between a suction cutoff position and a position communicating with a discharge port, divert the pressure into the discharge chamber are provided along a spiral direction of spiral wraps. Among the pairs of step parts, step parts located on a lower side in a gravitational direction are located in a range of from 0° to 45° in a scroll turn direction relative to a horizontal direction.

According to the present invention, bypass ports that, when a pressure in the pair of compression chambers reaches or exceeds a set pressure at an intermediate compression position between a suction cutoff position and a position communicating with a discharge port, divert the pressure into the discharge chamber are provided along a spiral direction of spiral wraps. Among the pairs of step parts, step parts located on a lower side in a gravitational direction are located in a range of from 0° to 45° in a scroll turn direction relative to a horizontal direction. Even if the horizontal step scroll compressor is started up in a state where liquid refrigerant has accumulated, the step parts, among the pairs of step parts, located on the lower side in the gravitational direction are located in a range of from 0° to 45° in a scroll turn direction relative to a horizontal direction. By making the amount of liquid refrigerant trapped in the first compression chamber including the step parts located on the lower side in the gravitational direction when the step parts begin to engage equal to the amount of liquid refrigerant trapped in the second compression chamber forming a pair therewith, and diverting the liquid refrigerants to the discharge chamber through the bypass ports, a risk of liquid compression arising in the first and second compression chambers, or in other words, in the posterior compression chamber and the anterior compression chamber forming a pair, can be reduced. Accordingly, liquid compression can be effectively prevented during liquid migration startup of the horizontal step scroll compressor, which makes it possible to reduce the risk of damage or the like to the spiral wraps caused by liquid compression and improve the reliability thereof.

Furthermore, in the horizontal step scroll compressor according to the second aspect, it is preferable that the step parts located on the lower side in the gravitational direction be located in a range of from 20° to 40° in the scroll turn direction relative to the horizontal direction.

According to the present invention, the step parts located on the lower side in the gravitational direction are located in a range of from 20° to 40° in the scroll turn direction relative to the horizontal direction. Accordingly, the amount of liquid refrigerant trapped in the first compression chamber including the step parts on the lower side in the gravitational direction when the step parts begin to engage and the amount of liquid refrigerant trapped in the second compression chamber that forms a pair therewith can be brought closer in the direction of being equal, and the risk of liquid compression arising in the first and second compression chambers can be reduced. As a result, liquid compression in the respective compression chambers can be reliably prevented in the compression process following the beginning of engagement of the step parts, and the durability and reliability of the horizontal step scroll compressor can be ensured with respect to liquid migration startup.

Furthermore, in the horizontal step scroll compressor according to the second aspect, it is preferable that the step parts located on the lower side in the gravitational direction be located at a position of 30° in the scroll turn direction relative to the horizontal direction.

According to the present invention, the step parts located on the lower side in the gravitational direction are located at a position of 30° in the scroll turn direction relative to the horizontal direction. Accordingly, the amount of liquid refrigerant trapped in the first compression chamber including the step parts on the lower side in the gravitational direction when the step parts begin to engage and the amount of liquid refrigerant trapped in the second compression chamber that forms a pair therewith can be made essentially equal, and the risk of liquid compression arising in the first and second compression chambers can be reduced even further. Accordingly, liquid compression in the respective compression chambers can be reliably prevented in the compression process following the beginning of engagement of the step parts, and the durability and reliability of the horizontal step scroll compressor can be ensured with respect to liquid migration startup.

Advantageous Effects of Invention

According to the present invention, even if the horizontal step scroll compressor has been started up in a state where liquid refrigerant has accumulated, excessive liquid compression can be prevented from arising on the first compression chamber side, where it is easy for liquid compression to arise, by diverting the liquid refrigerant trapped in the first compression chamber including the step parts on the lower side in the gravitational direction when the step parts begin to engage, to the discharge chamber via the bypass port whose opening area is greater. Accordingly, liquid compression can be effectively prevented during liquid migration startup of the horizontal step scroll compressor, which makes it possible to reduce the risk of damage or the like to the scrolls caused by liquid compression and improve the reliability thereof.

Additionally, according to the present invention, even if the horizontal step scroll compressor is started up in a state where liquid refrigerant has accumulated, the step parts, among the pairs of step parts, located on the lower side in the gravitational direction are located in a range of from 0° to 45° in a scroll turn direction relative to a horizontal direction. By making the amount of liquid refrigerant trapped in the first compression chamber including the step parts located on the lower side in the gravitational direction when the step parts begin to engage equal to the amount of liquid refrigerant trapped in the second compression chamber forming a pair therewith, and diverting the liquid refrigerants to the discharge chamber through the bypass ports, a risk of liquid compression arising in the first and second compression chambers, or in other words, in the posterior compression chamber and the anterior compression chamber forming a pair, can be reduced. Accordingly, liquid compression can be effectively prevented during liquid migration startup of the horizontal step scroll compressor, which makes it possible to reduce the risk of damage or the like to the spiral wraps caused by liquid compression and improve the reliability thereof.

DESCRIPTION OF EMBODIMENTS

Embodiments of the present invention will be described below with reference to the drawings.

[First Embodiment]

A first embodiment of the present invention will be described below, using FIGS. 1 to 3D and 5.

Figure 1:
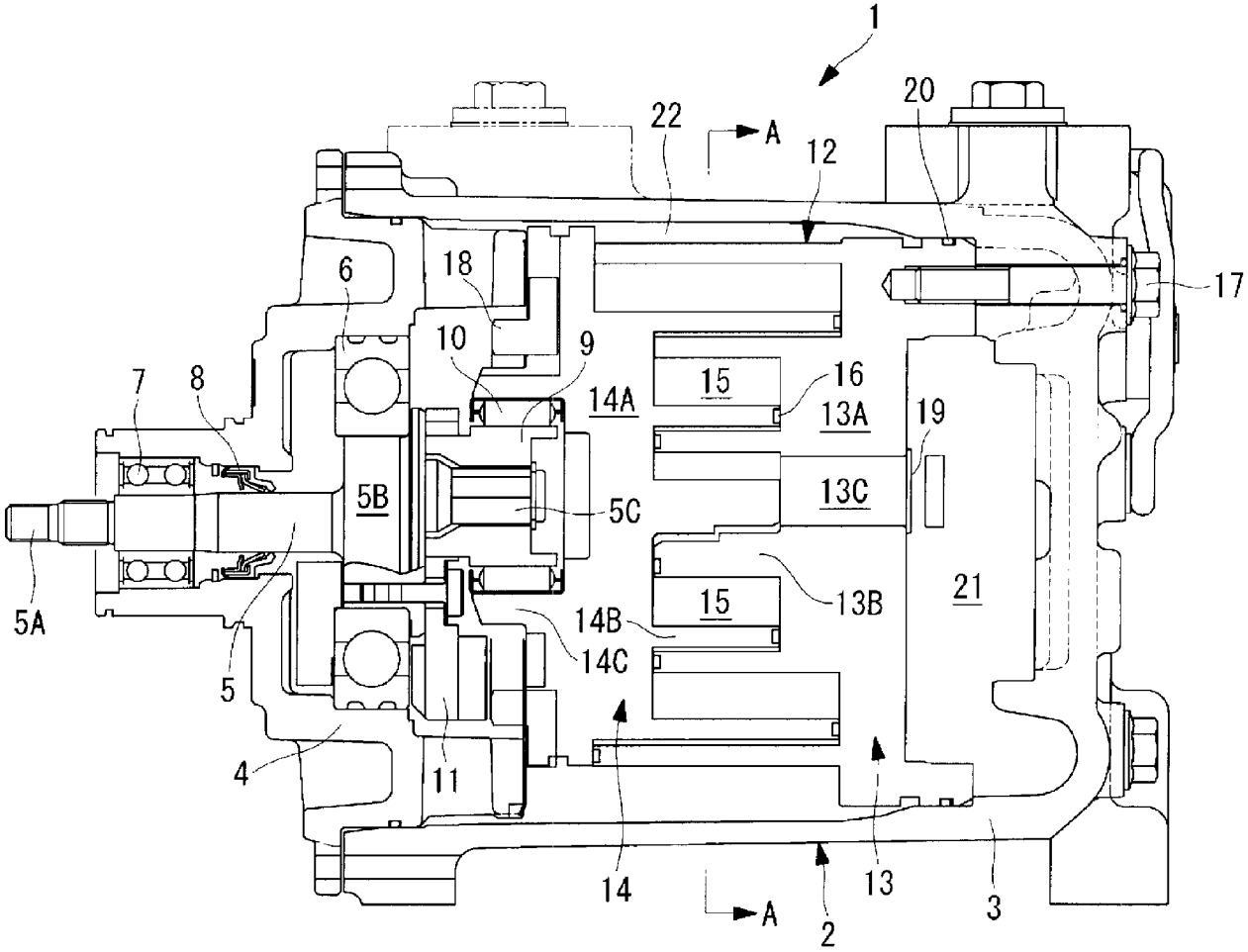
FIG. 1 is a vertical cross-sectional view of a horizontal step scroll compressor according to a first embodiment of the present invention.
Figure 2:
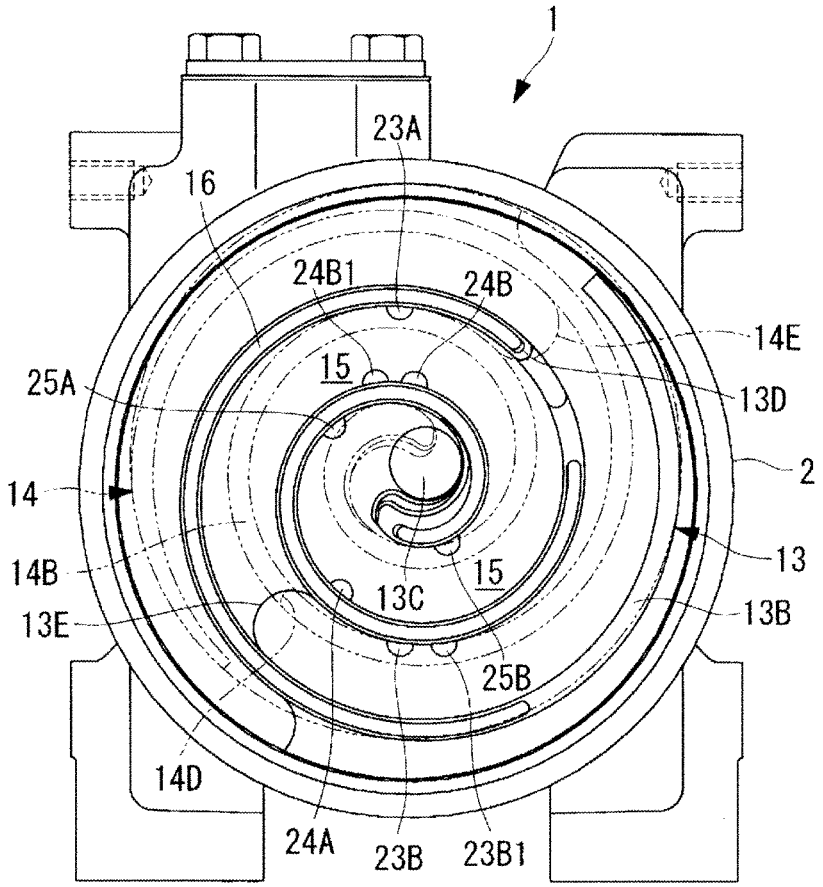
FIG. 2 is a cross-sectional view taken along A-A in FIG. 1.
Figure 3A:
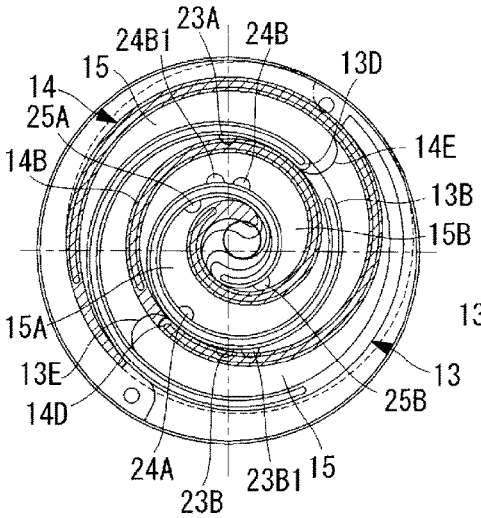
FIGS. 3A to 3D are explanatory diagrams of compression operations illustrating a transition in a state of engagement of stationary and revolving scrolls in the stated scroll compressor.
Figure 3B:
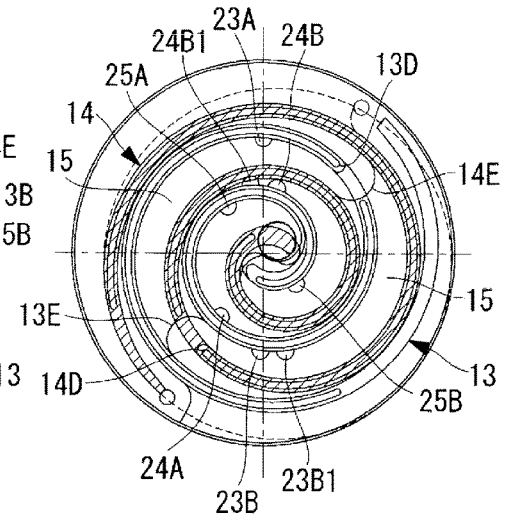
Figure 3C:
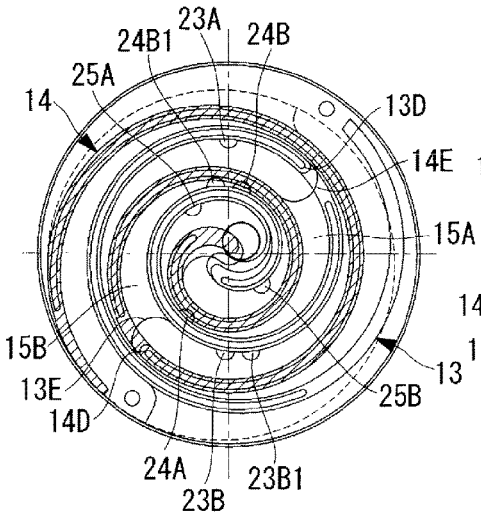
Figure 3D:
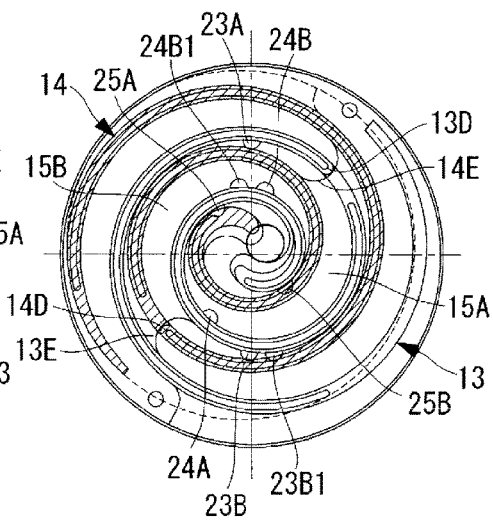

FIG. 1 is a vertical cross-sectional view of a horizontal step scroll compressor according to the first embodiment of the present invention. FIG. 2 is a cross-sectional view taken along A-A in FIG. 1, and FIGS. 3A to 3D are explanatory diagrams of compression operations of the stated scroll compressor.

A horizontal step scroll compressor 1 includes a housing 2 constituting an outer shell. The housing 2 is formed from a closed-ended cup-shaped housing 3 that is sealed on one end and a front housing 4 fitted and mounted to the open-ended side of the cup-shaped housing 3, with the two housings fastened and fixed to each other using bolts or the like to form an integrated unit.

Inside the front housing 4, a crank shaft 5 is supported by a main bearing 6 and a sub bearing 7 so as to be capable of freely rotating around an axis of the crank shaft 5. One end side of the crank shaft 5 (a left end side in FIG. 1) serves as a small-diameter shaft part 5A, and the small-diameter shaft part 5A passes through the front housing 4 and protrudes to the left in FIG. 1. A known electromagnetic clutch, pulley, or the like that receives motive power from the exterior is provided on an end of the small-diameter shaft part 5A protruding to the exterior, and motive power is inputted from an external driving source such as an engine via a belt. A lip seal 8 is installed between the main bearing 6 and the sub bearing 7, forming a seal between the interior of the housing 2 and the atmospheric air.

A large-diameter shaft part 5B is provided on another end side of the crank shaft 5 (a right end side in FIG. 1). A crank pin 5C that is decentered from the axis of the crank shaft 5 by a predetermined dimension is provided integrally with the large-diameter shaft part 5B. By the large-diameter shaft part 5B and the small-diameter shaft part 5A being supported via the main bearing 6 and the sub bearing 7, the crank shaft 5 is supported by the front housing 4 so as to be capable of freely rotating. A revolving scroll 14, which will be described later, is connected to the crank pin 5C via a drive bushing 9 and a revolving bearing 10, and the revolving scroll 14 is driven to revolve by rotational driving of the crank shaft 5.

A pin hole 9A into which the crank pin 5C is fitted is provided in the drive bushing 9. The crank pin 5C and the revolving scroll 14 are connected by fitting, via the revolving bearing 10, a boss part 14C of the revolving scroll 14 onto the outer circumference of the drive bushing 9 that is fitted to the crank pin 5C. A known slave crank mechanism that makes the turn radius of the revolving scroll 14 variable may be provided between the drive bushing 9 and the crank pin 5C. Additionally, a balance weight 11 for eliminating unbalanced loads produced by the revolving scroll 14 revolving is provided on the drive bushing 9, and is driven to revolve along with the revolving scroll 14.

A scroll compressor mechanism (compression mechanism) 12 constituted of a stationary scroll 13 and the revolving scroll 14, which form a pair, is incorporated into the housing 2. The stationary scroll 13 is constituted of an end plate 13A and a spiral wrap 13B erected from the end plate 13A, and the revolving scroll 14 is constituted of an end plate 14A and a spiral wrap 14B erected from the end plate 14A.

The stationary scroll 13 and the revolving scroll 14 according to the present embodiment include step parts 13D and 13E and step parts 14D and 14E, respectively, provided in predetermined positions of tooth crests and tooth bases of the spiral wraps 13B and 14B along the spiral directions thereof (see FIG. 2). The tooth crests of the spiral wraps 13B and 14B are formed such that a tooth crest on an outer peripheral side in a revolution axial direction is higher and a tooth crest on an inner peripheral side is lower on the respective sides of the step parts 13D and 13E and step parts 14D and 14E. On the other hand, the tooth bases are formed such that a tooth base on the outer peripheral side in the revolution axial direction is lower and a tooth base on the inner peripheral side is higher. As a result, the spiral wraps 13B and 14B have a higher wrap height on the outer peripheral side than the wrap height on the inner peripheral side.

The stationary scroll 13 and the revolving scroll 14 are engaged with each other such that the centers thereof are separated by an amount equivalent to the turn radius and the phases of the spiral wraps 13B and 14B shifted by 180 degrees, and are assembled such that a small clearance in the wrap height direction is present between the tooth crests and the tooth bases on the spiral wraps 13B and 14B of the respective scrolls at normal temperature. As a result, as illustrated in FIG. 1, a pair of compression chambers 15 delimited by the end plates 13A and 14A and the spiral wraps 13B and 14B are formed between the scrolls 13 and 14 so as to be symmetrical relative to the scroll centers, and the revolving scroll 14 revolves smoothly around the stationary scroll 13.

The compression chambers 15 are formed such that a height thereof in the revolution axial direction is greater on an outer peripheral side of the spiral wraps 13B and 14B than on an inner peripheral side, thus forming the compression mechanism 12 capable of three-dimensional compression in which a gas can be compressed not only in a circumferential direction of the spiral wraps 13B and 14B but also in a wrap height direction. Note that in the tooth crests of the spiral wraps 13B and 14B, a tip seal 16 that seals a tip seal surface formed with the tooth base of the partner scroll is fitted into a groove provided in the tooth crest. The horizontal step scroll compressor 1 configured in this manner is well-known.

The stationary scroll 13 is fixed to an inner bottom surface of the cup-shaped housing 3 by a plurality of bolts 17. Additionally, with the revolving scroll 14, the crank pin 5C provided on one end side of the crank shaft 5 is connected to the boss part 14C provided on a rear surface of the end plate 14A via the drive bushing 9 and the revolving bearing 10 as described above. Furthermore, the rear surface of the end plate 14A is supported by a thrust bearing surface of the front housing 4, and the revolving scroll 14 is driven so as to orbitally revolve around the stationary scroll 13 while being prevented from self-rotating by a self-rotation prevention mechanism 18 such as an Oldham coupling provided between the thrust bearing surface and the rear surface of the end plate 14A. The self-rotation prevention mechanism 18 may be a known pin-ring type self-rotation prevention mechanism.

A discharge port 13C that discharges compressed refrigerant gas is formed in the stationary scroll 13 in a central area of the end plate 13A. A discharge lead valve 19 is installed in the discharge port 13C via a retainer. Additionally, in the rear surface side of the end plate 13A of the stationary scroll 13, a seal member 20 such as an O-ring is provided so as to make tight contact with the inner surface of the cup-shaped housing 3, and a discharge chamber 21 sectioned off from the internal space of the housing 2 is formed with the inner surface of the cup-shaped housing 3. As a result, the configuration is such that the internal space of the housing 2 aside from the discharge chamber 21 functions as an intake chamber 22.

In the horizontal step scroll compressor 1 configured as described thus far, overcompression, liquid compression, and the like may arise in response to changes in operation conditions. In this case, excessive stress caused by the overcompression, liquid compression, or the like may be applied to, for example, base parts of the step parts 13D and 14D on the tooth crest sides of the spiral wraps 13B and 14B in the stationary scroll 13 and the revolving scroll 14. There is a risk that this stress will cause cracks to form in the bases of the step parts 13D and 14D and damage the spiral wraps 13B and 14B.

Accordingly, the present embodiment employs a configuration in which a plurality of pairs of bypass ports, namely first bypass ports 23A and 23B, second bypass ports 24A and 24B, and third bypass ports 25A and 25B, are provided along the spiral direction, opening into the respective compression chambers 15 and preventing overcompression or liquid compression in the overall compression stroke from a suction cutoff position of the pair of compression chambers 15 ($\theta d$), to when the step parts 13D and 14E and the step parts 13E and 14D begin to engage (a $\theta s$ position), through a position where that engagement ends ($\theta s+\pi$), and finally to a position where the pair of compression chambers 15 merge and communicate with the discharge port 13C ($\theta p$).

It is assumed that lead valves (not illustrated) that open the bypass ports 23A and 23B, 24A and 24B, and 25A and 25B to the discharge chamber 21 when pressure within the compression chambers 15 has reached or exceeded a set pressure are provided in the openings of the first bypass ports 23A and 23B, the second bypass ports 24A and 24B, and the third bypass ports 25A and 25B leading into the discharge chamber 21. Note that providing lead valves in this manner is known.

Furthermore, as described earlier, it has been discovered that in the horizontal step scroll compressor 1, liquid compression arising when starting up the compressor in a liquid migration state in which liquid refrigerant has migrated into the compressor while operation of the compressor is stopped arises more easily not in the compression chamber located on the lower side in the gravitational direction at the time of startup, but rather on the side of a first compression chamber (stationary posterior compression chamber) 15B including the step parts 13E and 14D on the lower side in the gravitational direction when the step parts 13D and 14E and the step parts 13E and 14D begin to engage. On the basis of this knowledge, the following configuration is employed in addition to the above-described first bypass ports 23A and 23B, second bypass ports 24A and 24B, and third bypass ports 25A and 25B in order to effectively prevent liquid compression arising when starting up from a liquid migration state.

That is, an additional first bypass port 23B1 is provided in addition to the first bypass port 23B that opens into the first compression chamber (stationary posterior compression chamber) 15B including the step parts 13E and 14D on the lower side in the gravitational direction when the step parts 13D and 14E and the step parts 13E and 14D begin to engage, so that an opening area of the first bypass ports 23B and 23B1 that open into the first compression chamber (stationary posterior compression chamber) 15B side is greater than an opening area of the first bypass port 23A that opens into a second compression chamber (stationary anterior compression chamber) 15A that forms a pair with the first compression chamber 15B. This makes it easier to divert the liquid refrigerant, and as a result prevents liquid compression.

Moreover, an additional second bypass port 24B1 is provided in a position of the second bypass port 24B that opens into the first compression chamber (stationary posterior compression chamber) 15B while the first compression chamber (stationary posterior compression chamber) 15B is moving from the position of the beginning of engagement ($\theta s$), through the engagement end position ($\theta s+\pi$), and to the position of communicating with the discharge port 13C ($\theta p$). As a result, an opening area of the second bypass ports 24B and 24B1 that open into the first compression chamber (stationary posterior compression chamber) 15B side is greater than an opening area of the second bypass port 24A that opens into the second compression chamber (stationary anterior compression chamber) 15A that forms a pair with the first compression chamber 15B. This makes it easier to divert the liquid refrigerant, and as a result ensures that liquid compression does not arise.

Note that it is assumed that lead valves that open the bypass ports 23B1 and 24B1 to the discharge chamber 21 when the pressure within the first compression chamber 15B has reached or exceeded a set pressure are also provided in the additionally-provided first bypass port 23B1 and second bypass port 24B1. The lead valves for the first bypass port 23B1 and the second bypass port 24B1 may be common with the lead valves provided for the first bypass port 23B and the second bypass port 24B.

According to the configuration described above, the present embodiment has the following operational effects.

In the horizontal step scroll compressor 1, a low-pressure refrigerant gas sucked into the intake chamber 22 within the housing 2 from an intake port (not illustrated) is sucked into the pair of compression chambers 15 by the revolving driving of the revolving scroll 14. This refrigerant gas undergoes three-dimensional compression while the compression chambers 15 move from the outer peripheral side toward the center side in the circumferential direction and wrap height direction of the spiral wraps 13B and 14B and decrease in volume, after which the pair of compression chambers 15 merge and communicate with the discharge port 13C. The discharge lead valve 19 opens and discharges into the discharge chamber 21 as a result. This high-pressure gas is sent to the exterior through a discharge port provided in the housing 2.

In this compression process, there are cases, depending on the operation conditions, where the pressure within the compression chambers 15 rises abnormally and produces a state of overcompression, liquid refrigerant is sucked in and the pressure rises abnormally under liquid compression, or the like. In such a case, there are cases where excessive stress caused by the overcompression, liquid compression, or the like is applied to base parts of the step parts 13D and 14D on the tooth crest sides of the spiral wraps 13B and 14B in the stationary scroll 13 and the revolving scroll 14. There is a risk that this concentration of stress will produce cracks in the bases of the step parts 13D and 14D and damage the spiral wraps 13B and 14B.

However, in the present embodiment, the plurality of pairs of bypass ports, namely the first bypass ports 23A and 23B, the second bypass ports 24A and 24B, and the third bypass ports 25A and 25B, are provided along the spiral direction, opening into the respective compression chambers 15 in the overall compression stroke from the suction cutoff position of the pair of compression chambers 15 (θd) to the position where the compression chambers 15 communicate with the discharge port 13C (θp). Accordingly, abnormal pressure caused by overcompression or liquid refrigerant under liquid compression in the compression chambers 15 can be diverted from the first bypass ports 23A and 23B, the second bypass ports 24A and 24B, and the third bypass ports 25A and 25B to the discharge chamber 21 sequentially via the lead valves. The risk of the spiral wraps 13B and 14B being damaged can be eliminated as a result.

On the other hand, liquid refrigerant may migrate and accumulate within the compression chambers 15 while operation of the horizontal step scroll compressor 1 is stopped. When the compressor is started up from this liquid migration state, it is known that in the horizontal step scroll compressor 1, liquid compression arises more easily on the side of the first compression chamber (stationary posterior compression chamber) 15B including the step parts 13E and 14D on the lower side in the gravitational direction when the step parts 13D and 14E and the step parts 13E and 14D begin to engage. The opening area of the first bypass ports 23B and 23B1 that open into the first compression chamber (stationary posterior compression chamber) 15B is greater than the opening area of the first bypass port 23A that opens into the second compression chamber (stationary anterior compression chamber) 15A that forms a pair with the first compression chamber (stationary posterior compression chamber) 15B.

Accordingly, it can be made easier to divert the liquid refrigerant on the first compression chamber (stationary posterior compression chamber) 15B side, where liquid compression arises more easily. This makes it possible to effectively prevent liquid compression in the horizontal step scroll compressor 1.

Meanwhile, the additional second bypass port 24B1 is provided in the position of the second bypass port 24B that opens into the first compression chamber (stationary posterior compression chamber) 15B while the first compression chamber (stationary posterior compression chamber) 15B is moving from the position of the beginning of engagement (θs), through the engagement end position (θs+π), and to the position of communicating with the discharge port 13C (θp), and thus provides a greater opening area than the second bypass port 24A that opens into the second compression chamber (stationary anterior compression chamber) 15A forming a pair with the first compression chamber 15B. Accordingly, liquid compression in the first compression chamber (stationary posterior compression chamber) 15B can be reliably suppressed in the entire compression process following the beginning of engagement of the step parts 13D and 14E and the step parts 13E and 14D.

Furthermore, in the above embodiment, the additional first bypass port 23B1 and second bypass port 24B2 are provided for the first bypass port 23B and the second bypass port 24B, respectively, in order to increase the opening area of the openings into the first compression chamber (stationary posterior compression chamber) 15B including the step parts 13E and 14D on the lower side in the gravitational direction when the step parts 13D and 14E and the step parts 13E and 14D begin to engage. This makes it easy to increase the opening area, which in turn makes it easy to divert the liquid refrigerant.

Note that rather than increasing the number of ports as described above, the first bypass port 23B and the second bypass port 24B themselves may, for example, be formed as long holes or the like in order to increase the opening area of the first bypass port 23B and the second bypass port 24B opening into the first compression chamber (stationary posterior compression chamber) 15B.

Figure 5:
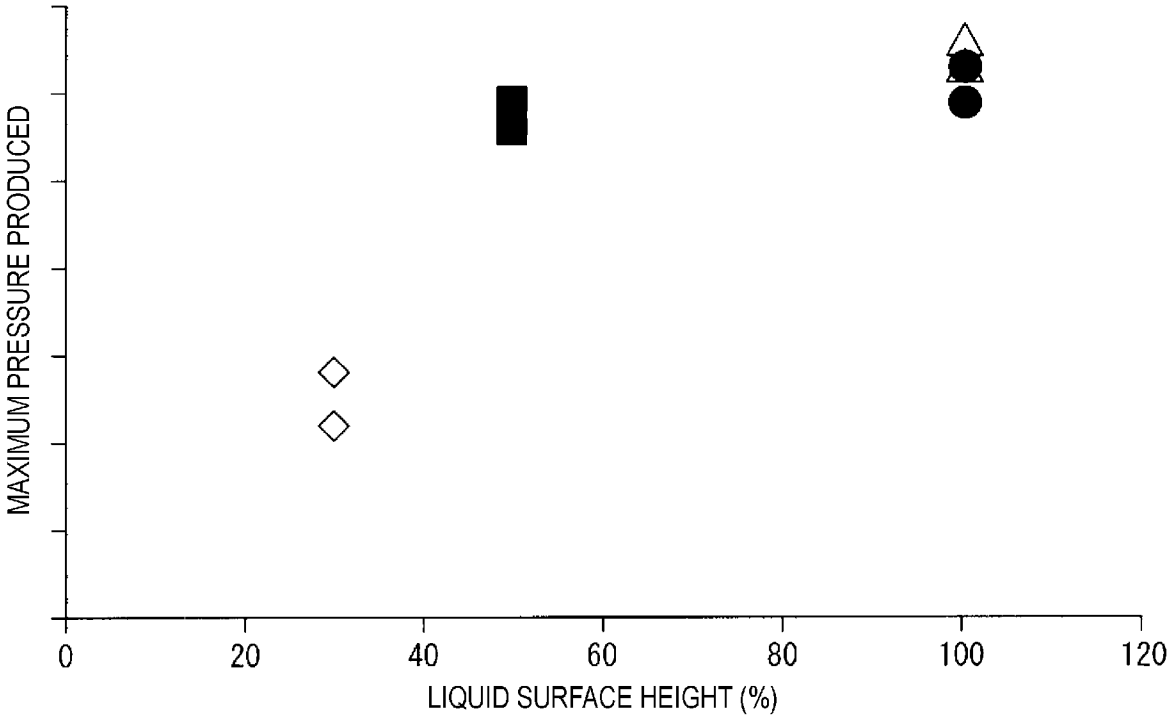
FIG. 5 is an explanatory diagram illustrating a relationship between a liquid surface height of liquid refrigerant that has accumulated in a compression chamber of the stated scroll compressor and a liquid compression pressure that is produced.
Figure 6A:
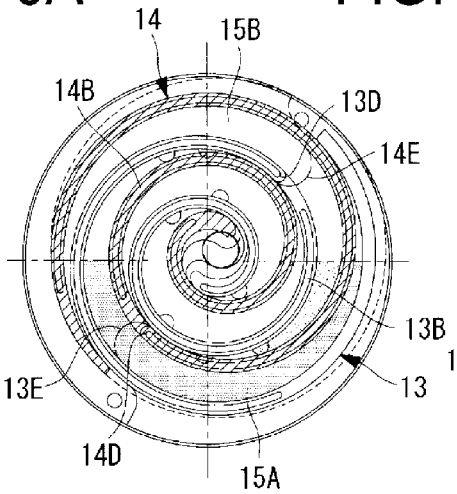
FIGS. 6A to 6D are explanatory diagrams of compression operations during liquid migration startup in the case where step parts of a horizontal step scroll compressor, on the lower side in the gravitational direction, are in a position of 45° on the lower-left relative to the horizontal direction.
Figure 6B:
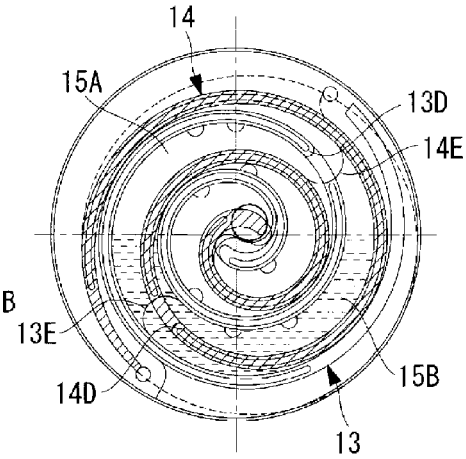
Figure 6C:
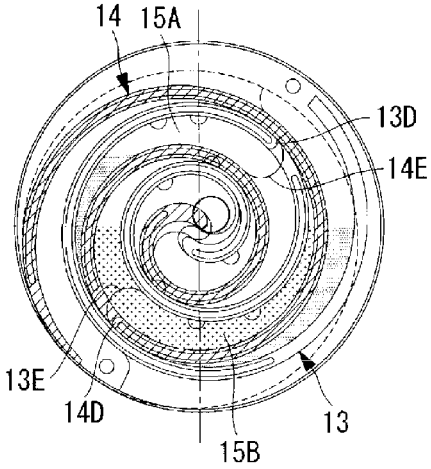
Figure 6D:
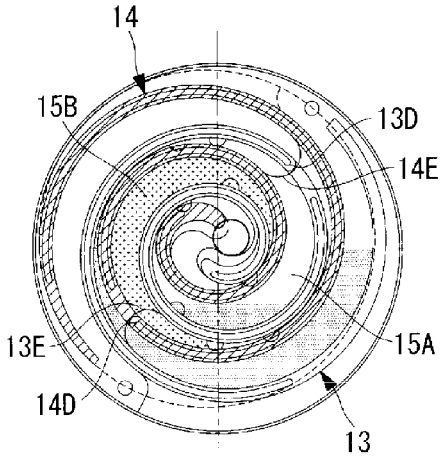
Figure 7A:
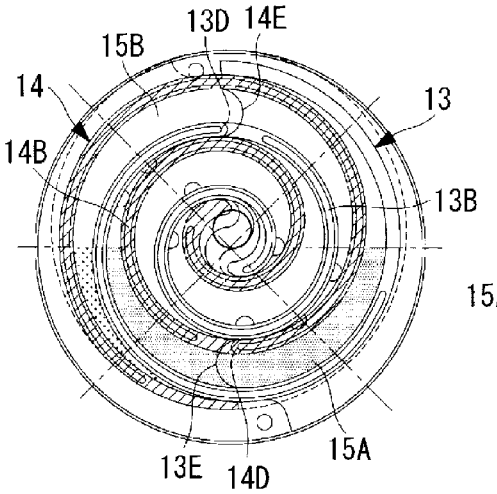
FIGS. 7A to 7D are explanatory diagrams of compression operations during liquid migration startup in the case where the step parts of the stated compressor, on the lower side in the gravitational direction, are positioned at a center-bottom position relative to the horizontal direction.
Figure 7B:
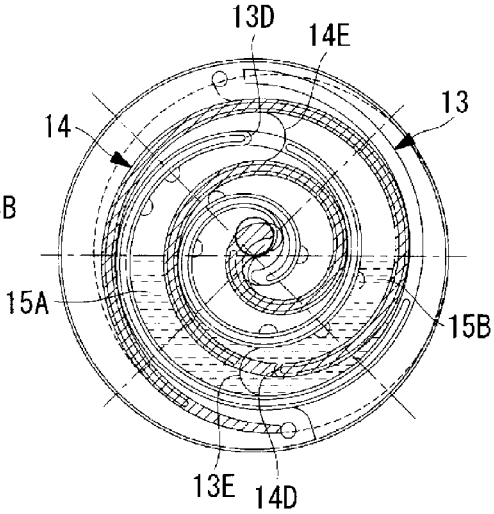
Figure 7C:
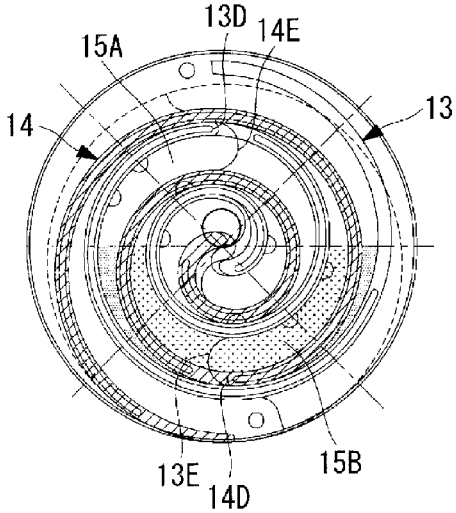
Figure 7D:
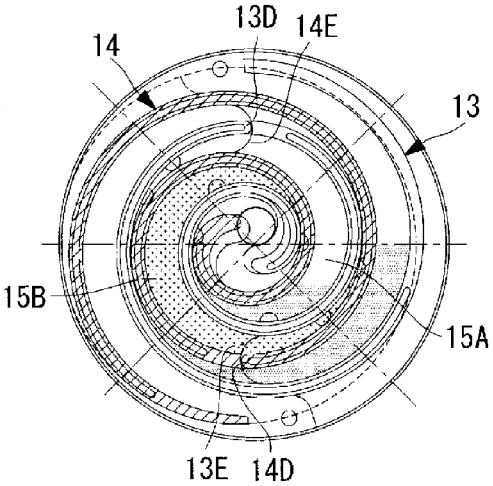
Figure 8A:
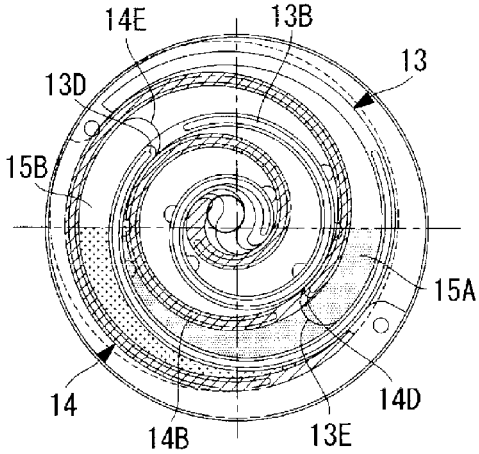
FIGS. 8A to 8D are explanatory diagrams of compression operations during liquid migration startup in the case where the step parts of the stated compressor, on the lower side in the gravitational direction, are in a position of 45° on the lower-right relative to the horizontal direction.
Figure 8B:
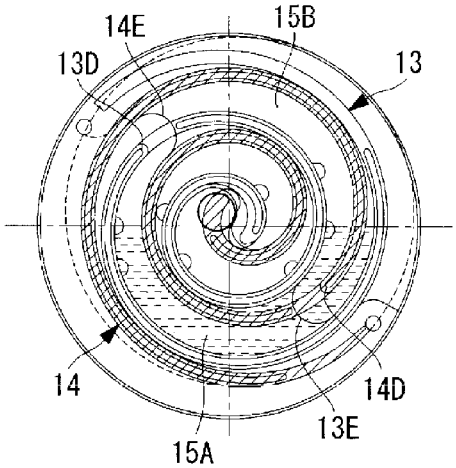
Figure 8C:
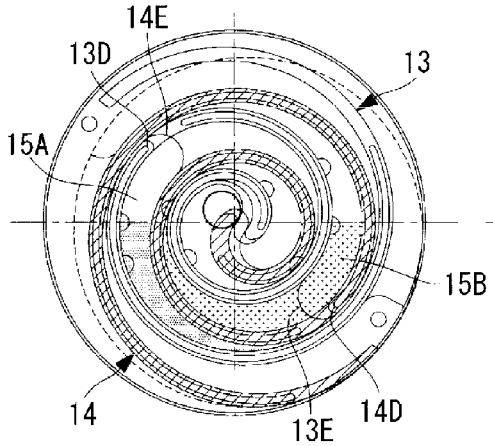
Figure 8D:
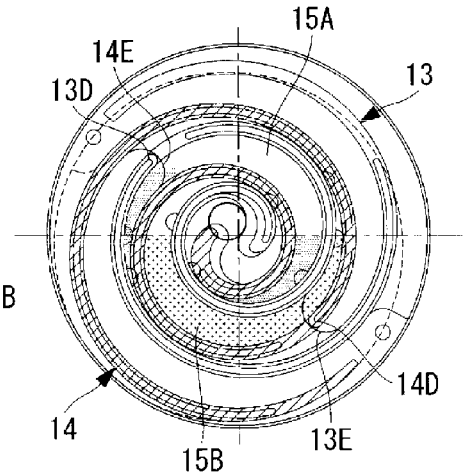
Figure 9A:
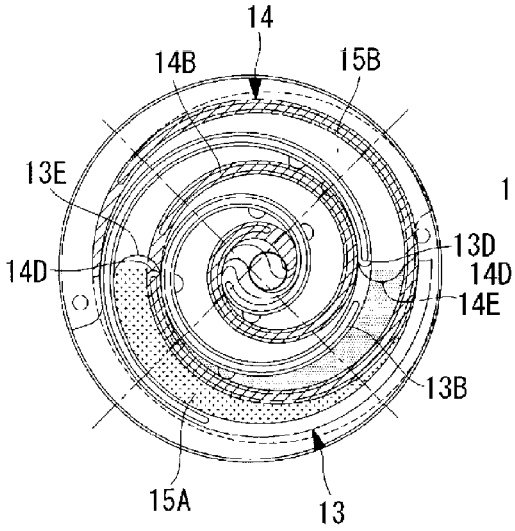
FIGS. 9A to 9D are explanatory diagrams of compression operations during liquid migration startup in the case where the step parts of the stated compressor, on the lower side in the gravitational direction, are positioned at a center-side position (a horizontal position) relative to the horizontal direction.
Figure 9B:
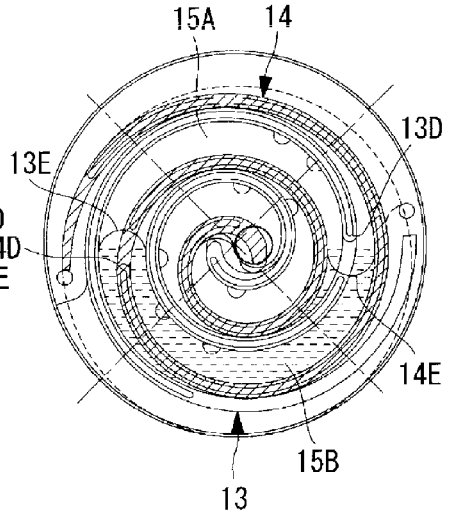
Figure 9C:
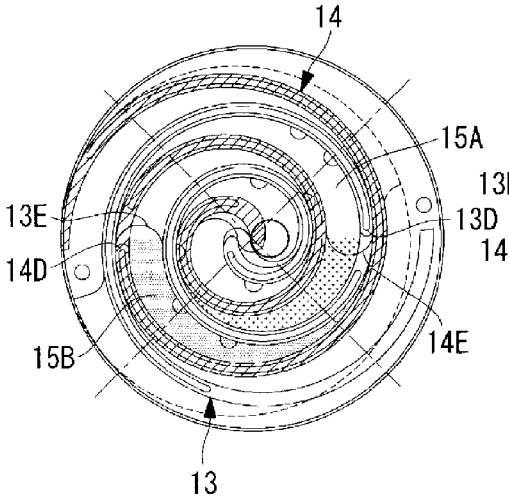
Figure 9D:
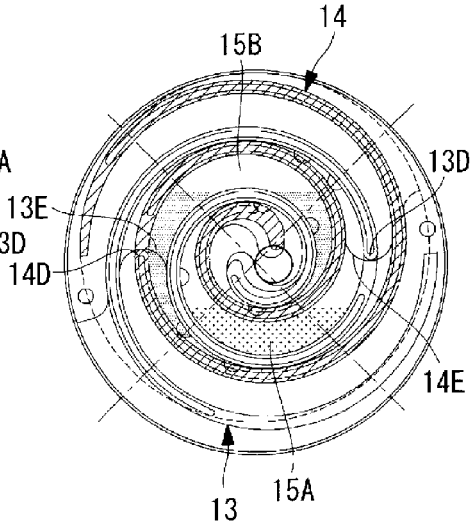

It goes without saying that the degree of the aforementioned liquid compression is affected by the amount of liquid refrigerant accumulated within the compression chambers 15. As illustrated in FIG. 5, in a case where the liquid refrigerant has accumulated to where the pair of compression chambers 15 are full (a liquid surface height of 100%) at, for example, the suction cutoff position (θd), there is no point in making it easy to discharge liquid from one of the compression chambers 15. That is, additional measures are necessary in such a case. Conversely, in a case where the liquid surface height is less than or equal to 30%, pressure produced by liquid compression will be less than or equal to a permissible range and thus poses no problem. The above-described effects are thus thought to be useful when the liquid surface height is in a range greater than 30% and up to approximately 70%.

[Second Embodiment]

A second embodiment of the present invention will be described below, using FIGS. 4A to 4E.

The present embodiment differs from the above-described first embodiment in that liquid compression is prevented by setting the positions of the step parts 13E and 14D located on the lower side in the gravitational direction to an appropriate range, without changing the opening area of the bypass ports. Other points are similar to the first embodiment, so descriptions thereof will be omitted here.

In other words, the present embodiment was arrived at on the basis of knowledge that changing set positions of the step parts 13E and 14D located on the lower side in the gravitational direction produces a change in the amount of liquid refrigerant trapped in the first compression chamber (stationary posterior compression chamber) 15B including the step parts 13E and 14D on the lower side in the gravitational direction when the step parts 13E and 14D and the step parts 13D and 14E begin to engage.

As illustrated in FIGS. 4A to 4E, even if the same amount of liquid refrigerant is trapped in the compression chambers 15, changing the positions of the step parts 13E and 14D produces a change in the amount of liquid refrigerant trapped in the first compression chamber (stationary posterior compression chamber) 15B including the step parts 13E and 14D on the lower side in the gravitational direction when the step parts 13E and 14D and the step parts 13D and 14E begin to engage. This is as described earlier with reference to FIGS. 6A to 9D, and FIGS. 4A to 4D are diagrams corresponding to FIGS. 6C, 7C, 8C, and 9C, respectively.

Figure 4A:
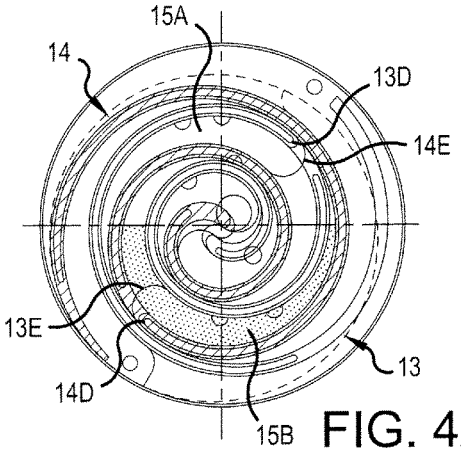
FIGS. 4A to 4E are explanatory diagrams of compression operations illustrating a transition in a state of engagement of both scrolls in a horizontal step scroll compressor according to a second embodiment of the present invention.

FIG. 4A illustrates the positions of the step parts 13E and 14D on the lower side in the gravitational direction being set to a position of 45° on the lower-left relative to the horizontal direction. FIGS. 4B, 4C, 4D, and 4E illustrate states of compression in the case where the positions of the step parts 13E and 14D are set to a center-bottom position, the positions of the step parts 13E and 14D are set to a position of 45° on the lower-right, the positions of the step parts 13E and 14D are set to a center-side position (a horizontal position), and the positions of the step parts 13E and 14D are set to a position of 30° on the lower-right, respectively. As illustrated in these drawings, the amount of liquid refrigerant trapped in the first compression chamber (stationary posterior compression chamber) 15B including the step parts 13E and 14D on the lower side in the gravitational direction when the step parts 13E and 14D and the step parts 13D and 14E begin to engage changes.

Figure 4B:
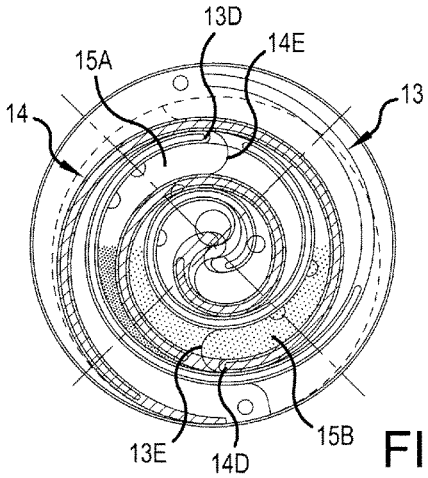

In the cases of FIGS. 4A and 4B, the amount of liquid refrigerant trapped on the first compression chamber (stationary posterior compression chamber) 15B side is far greater than the amount of liquid refrigerant trapped in the second compression chamber (stationary anterior compression chamber) 15A that forms a pair therewith, and thus it is easier for liquid compression to arise in the first compression chamber (stationary posterior compression chamber) 15B. However, in the cases of FIGS. 4C and 4D, the amount of liquid refrigerant trapped in the first compression chamber (stationary posterior compression chamber) 15B is essentially the same as the amount of liquid refrigerant trapped in the second compression chamber (stationary anterior compression chamber) 15A that forms a pair therewith (there is slightly more on the first compression chamber 15B side in the case of FIG. 4C and slightly more on the second compression chamber 15A side in the case of FIG. 4D). In the case of FIG. 4E, the amount of liquid refrigerant trapped in the compression chambers 15A and 15B is closer to being equal.

In this manner, making the amount of liquid refrigerant trapped in the first compression chamber (stationary posterior compression chamber) 15B including the step parts 13E and 14D on the lower side in the gravitational direction when the step parts 13E and 14D and the step parts 13D and 14E begin to engage equal to the amount of liquid refrigerant trapped in the second compression chamber (stationary anterior compression chamber) 15A that forms a pair with the compression chamber 15B means that the amounts of liquid refrigerant trapped in the compression chambers 15A and 15B can be reduced and the risk of liquid compression can be reduced.

Figure 4C:
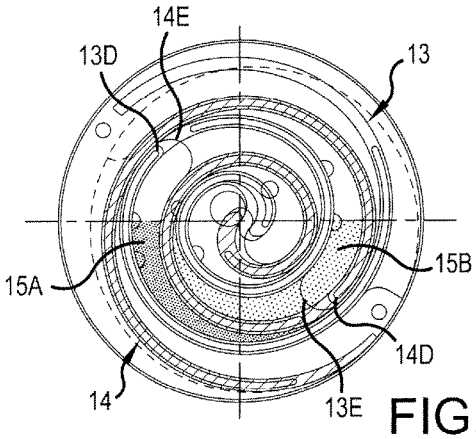
Figure 4D:
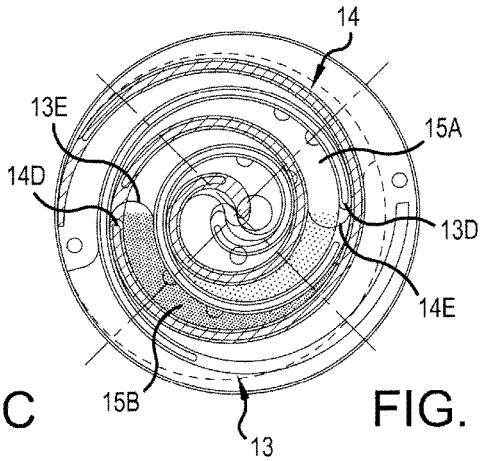
Figure 4E:
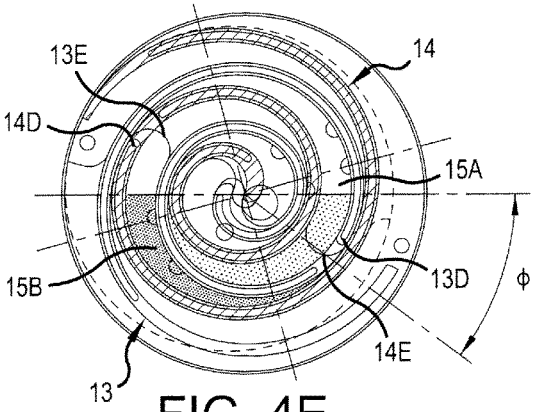

On the basis of the stated knowledge, in the horizontal step scroll compressor 1 provided with the first bypass ports 23A and 23B, the second bypass ports 24A and 24B, and the third bypass ports 25A and 25B that are open in the overall compression stroke from the suction cutoff position of the pair of compression chambers 15 (θd) to the position where the compression chambers 15 communicate with the discharge port 13C (θp) and prevent overcompression or liquid compression in the compression chambers 15 as in the first embodiment, the present embodiment sets the positions of the step parts 13E and 14D on the lower side in the gravitational direction to the ranges indicated in FIGS. 4C to 4E, or in other words, to a range of from 0° to 45° in the clockwise direction (the scroll turn direction) relative to the horizontal direction, preferably to a range of from 20° to 40° in the scroll turn direction relative to the horizontal direction, and more preferably to a position of 30° (ϕ=30° in FIG. 4E) in the scroll turn direction relative to the horizontal direction.

As described above, the positions of the step parts 13E and 14D on the lower side in the gravitational direction are set to a range of from 0° to 45° in the scroll turn direction relative to the horizontal direction, preferably to a range of from 20° to 40°, and more preferably to a position of 30°. In this manner, the amount of liquid refrigerant trapped in the first compression chamber (stationary posterior compression chamber) 15B including the step parts 13E and 14D on the lower side in the gravitational direction when the step parts 13E and 14D and the step parts 13D and 14E begin to engage can be made approximately equal to the amount of liquid refrigerant trapped in the second compression chamber (stationary anterior compression chamber) 15A that forms a pair with the compression chamber 15B.

Thus, according to the present embodiment as well, liquid compression can be effectively prevented during liquid migration startup of the horizontal step scroll compressor 1, which makes it possible to reduce the risk of damage or the like to the scrolls caused by liquid compression and improve the reliability thereof.

Note that the present invention is not limited to the invention according to the above-described embodiments and can be modified as appropriate without departing from the spirit of the present invention. For example, although the foregoing embodiments describe examples in which the present invention is applied in a type of horizontal step scroll compressor 1 in which a first end portion of the crank shaft 5 protrudes outward from the housing 2 and the compressor is driven by motive power received from the exterior, the present invention can of course be similarly applied in a hermetically sealed horizontal step scroll compressor in which an electric motor is installed integrally within the housing 2 and the compressor is driven by that electric motor.

Additionally, although the foregoing embodiments describe a configuration in which the first bypass ports 23A and 23B, the second bypass ports 24A and 24B, or the third bypass ports 25A and 25B open into the pair of compression chambers 15 in the overall compression stroke from the suction cutoff position (θd) to the position where the compression chambers 15 communicate with the discharge port 13C (θp), it goes without saying that the present invention can be similarly applied in a horizontal step scroll compressor 1 in which bypass ports are provided in a range from a position where the step parts 13D and 14E and the step parts 13E and 14D begin to engage (the θs position) to the position of communication with the discharge port 13C (θp) or a range from a position where those step parts begin to engage (the θs position) to the position where the engagement ends (θs+π).

REFERENCE SIGNS LIST

1 Horizontal step scroll compressor
13 Stationary scroll
13B, 14B Spiral wrap
13C Discharge port
13D, 14D Step part of tooth crest
13E, 14E Step part of tooth base
14 Revolving scroll
15 Compression chamber
15A Second compression chamber (stationary anterior compression chamber)
15B First compression chamber (stationary posterior compression chamber)
21 Discharge chamber
23A, 23B, 23B1 First bypass port
24A, 24B, 24B1 Second bypass port
25A, 25B Third bypass port

The invention claimed is:

1. A horizontal step scroll compressor in which step parts are provided in each of positions of tooth crests and tooth bases in spiral wraps of a stationary scroll and a revolving scroll forming a pair of compression chambers comprising a first compression chamber and a second compression chamber along the spiral directions thereof, and in which a height of the spiral wrap on an outer peripheral side thereof is greater than a height of the wrap on an inner peripheral side thereof on the respective sides of the step parts, the horizontal step scroll compressor comprising:

at least one first bypass port opens into the first compression chamber and at least one second bypass port opens into the second compression chamber;

when a pressure in the pair of compression chambers reaches or exceeds a set pressure at an intermediate compression position between a suction cutoff position and a position communicating with a discharge port, divert the pressure into the discharge chamber being provided along a spiral direction of spiral wraps; and an opening area of the at least one first bypass port that opens into the first compression chamber including the step parts on a lower side in a gravitational direction when the step parts begin to engage being greater than an opening area of the at least one second bypass port that opens into the second compression chamber forming a pair with the first compression chamber.

2. The horizontal step scroll compressor according to claim 1, wherein a second set of bypass ports are provided along the spiral direction from the at least one first bypass port and the at least one second bypass port;

the second set of bypass ports including at least one third bypass port opening to the first compression chamber and at least one fourth bypass port opening to the second compression chamber;

an opening area of the at least one third bypass port open in a range from a position before the first compression chamber is closed to the at least one third bypass port to a position where the first compression chamber communicates with the discharge port is also greater than an opening area of the at least one fourth bypass port open in a range from a position before the second compression chamber is closed to the second bypass port to a position where the second compression chamber communicates with the discharge port.

3. The horizontal step scroll compressor according to claim 2, wherein the opening area is increased by providing a greater number of the first bypass ports and/or the third bypass ports opening into the first compression chamber than the second bypass ports and/or the fourth bypass ports opening into the second compression chamber.

4. The horizontal step scroll compressor according to claim 2, wherein the opening area is increased by giving the at least one first bypass port and/or the at least one third bypass port opening into the first compression chamber a greater port area per port than the port area per port of the at least one second bypass ports and/or the at least one fourth bypass ports opening into the second compression chamber.

5. The horizontal step scroll compressor according to claim 1, wherein the opening area is increased by providing a greater number of first bypass ports opening into the first compression chamber than the second bypass ports opening into the second compression chamber.

6. The horizontal step scroll compressor according to claim 1, wherein the opening area is increased by giving the at least one first bypass port opening into the first compression chamber a greater port area per port than the port area per port of the at least one second bypass port opening into the second compression chamber.

7. A horizontal step scroll compressor in which step parts are provided in each of positions of tooth crests and tooth bases in spiral wraps of a stationary scroll and a revolving scroll forming a pair of compression chambers along the spiral directions thereof, and in which a height of the spiral wrap on an outer peripheral side thereof is greater than a height of the wrap on an inner peripheral side thereof on the respective sides of the step parts, the horizontal step scroll compressor comprising:

bypass ports that, when a pressure in the pair of compression chambers reaches or exceeds a set pressure at an intermediate compression position between a suction cutoff position and a position communicating with a discharge port, divert the pressure into the discharge chamber being provided along a spiral direction of spiral wraps; and the step parts located on a lower side in a gravitational direction are located in a range of from 0° to 45° in a scroll turn direction relative to a horizontal direction.

8. The horizontal step scroll compressor according to claim 7, wherein the step parts located on the lower side in the gravitational direction are located in a range of from 20° to 40° in the scroll turn direction relative to the horizontal direction.

9. The horizontal step scroll compressor according to claim 7, wherein the step parts located on the lower side in the gravitational direction are located at a position of 30° in the scroll turn direction relative to the horizontal direction.

* * * * *